US007096818B2

(12) United States Patent
Kalil

(10) Patent No.: US 7,096,818 B2
(45) Date of Patent: Aug. 29, 2006

(54) DECK/DASH ASSEMBLY AND METHOD

(76) Inventor: Anthony Kalil, 408 W. University Ave. #9C, Gainesville, FL (US) 32601

( * ) Notice: Subject to any disclaimer, the term of this patent is extended or adjusted under 35 U.S.C. 154(b) by 0 days.

(21) Appl. No.: 10/974,231

(22) Filed: Oct. 27, 2004

(65) Prior Publication Data

US 2005/0120937 A1 Jun. 9, 2005

Related U.S. Application Data

(60) Provisional application No. 60/514,862, filed on Oct. 27, 2003.

(51) Int. Cl.
*B63B 17/00* (2006.01)

(52) U.S. Cl. ..... 114/364; 296/70

(58) Field of Classification Search ..... 114/343, 114/364; 296/70, 72; 180/90; 248/27.1; 439/374

See application file for complete search history.

(56) References Cited

U.S. PATENT DOCUMENTS 4,706,810 A * 11/1987 Petrilli ..... 114/343
5,788,532 A * 8/1998 Takiguchi et al. ..... 439/374
6,129,406 A * 10/2000 Dauvergne ..... 296/70
6,666,413 B1 * 12/2003 Nakajima ..... 248/27.1
6,739,281 B1 * 5/2004 Grimes ..... 114/364
6,767,041 B1 * 7/2004 Shiono ..... 296/70
6,779,826 B1 * 8/2004 Nakajima ..... 296/70

* cited by examiner

*Primary Examiner*—Lars A. Olson
(74) *Attorney, Agent, or Firm*—Saliwanchik, Lloyd & Saliwanchik

(57) ABSTRACT

A dash system that allows it to be fastened independently of the related and non-related components using an engagement system that captures the forward edge of the dash. The dash is "slid" into place from the rear, and then locked into place with a fastener at the rear facing edge, which is easily accessed. This sliding action allows the forward deck engaging means to engage its matching receiver that is designed into the deck surface of the boat. The deck/dash engagement system enables the dash to be removed without the need to remove many other elements surrounding the dash area. Alternatively, or in addition to the fastener proximal to the rear facing edge, a single fastener at the forward or leading edge in proximity to the forward latching or deck engaging means is sufficient to secure the deck to the deck surface while still providing ease of access and removal.

52 Claims, 8 Drawing Sheets

DECK/DASH ASSEMBLY AND METHOD

CROSS-REFERENCE TO A RELATED APPLICATION

This application claims the benefit of U.S. Provisional Application Ser. No. 60/514,862, filed Oct. 27, 2003.

BACKGROUND OF INVENTION

Almost all boats have some form of user interface that communicates the boat's functions and engine operations through a series of gauges, switches, or audible alarms. This interface is more commonly known as a dash console, and can take several different forms, depending on what style, or use of boat, it is designed for. For example, a fishing type of vessel, more commonly known as a "center console" boat, has the driver interface located in a large console placed on the center line of the vessel, with other elements such as seats, storage compartments, head compartments, or other structures attached to it forward of the driver interface. Conversely, pleasure types of boats that can be categorized as deck boats, pontoon boats, ski boats, bowrider boats, cuddy cabin boats, or cruisers most often have a driver interface placed to one side of the vessel, and may have a similar type of passenger interface, usually consisting of but not limited to radio functions, storage areas, cooler compartments, or access doors, placed on the other side of the vessel.

Regardless of the placement of the dash, several criteria, including pre-wiring of the instrument and switch panels, assembling and "loading" of the panels with gauges and/or access doors, as well as stenciling warning or instructive labels, have necessitated that the dashes be built as a separate unit, and be fastened to the boat as an assembly to maintain efficient production of the boat. This assembly can encompass all of the elements of the driver side dash and/or passenger side dash, and fasten as one complete assembly, or can be a portion of the assembly, usually containing at the least, the upper instrument panel and gauges, or storage doors, with one or several minor panels or components attaching to the boat on the general interface area.

The dashes are usually fastened to the deck of the boat with screws, bolts, or studs along the perimeter of the joining seam of the dash and the deck of the boat. Most often, the dashes are mounted to the deck of the boat before many related and non-related components of the boat are mounted, for they limit access to the fasteners required to secure the dash. These related and non-related components include, but are not limited to, steering systems, interior upholstery components, throttle and shifter systems, storage compartments, windshields and related hardware, braces or structural supports, handles or hand holds, additional gauges or electronic systems, doors, hatches, and partitions. Assembly and installation of these related and non-related systems often represent an expense of considerable time and labor during the manufacturing process of the boat.

Since the dashes are usually constructed of a combination of soft materials that are essential in maintaining a desirable tactile feeling of the driver interface, and highly decorative panels and/or delicate labels, they are prone to damage associated with the fastening of the related and non-related components. Resulting damage to the dashes usually requires many of the related and non-related components to be removed in order to access the fasteners that secure the dash in place. Additionally, regular maintenance or servicing of the dash requires similar measures to access wiring, gauges, or switches. Consequently, considerable time and labor revenues are lost whenever the dash needs to be removed for service or replacement. Accordingly, there exists a need in the art for improved methods of securing a dash to a boat, and for improved boat deck/dash assemblies.

SUMMARY OF THE INVENTION

The subject invention is a dash system that utilizes an improved method of fastening the dash, which allows it to be fastened independently of the related and non-related components. Rather than relying on fasteners placed around the perimeter of the joining seam of the dash and the deck surface, the invention utilizes an engagement system that captures the forward edge of the dash that is usually fastened with one or more screws or bolts. By capturing this forward edge, and securely holding it to the deck surface, the invention allows the dash to be "slid" into place from the rear, and then locked into place with a fastener such as a screw or bolt at the rear facing edge, which is easily accessed. This sliding action allows the forward latching or deck engaging means to engage its matching receiver or dash engaging means that is designed into the deck surface of the boat. The deck/dash engagement system effectively eliminates the need for forward fasteners, which are the fasteners commonly obstructed by the related and non-related elements, for example, such as the windshield; therefore enabling the dash to be removed or serviced without the need to remove many other elements surrounding the dash area. Alternatively, or in addition to the fastener proximal to the rear facing edge, a single fastener at the forward or leading edge in proximity to the forward latching or deck engaging means is sufficient to secure the deck to the deck surface while still providing ease of access and removal.

DETAILED DESCRIPTION

The subject invention is an improved method for attaching a dash to a boat deck surface, as well as an improved boat deck/dash assembly. A number of exemplary embodiments are disclosed, but the features common to all embodiments according to the subject invention are a dash having a leading edge, deck-engaging means proximal to the leading edge, and dash-engaging means disposed on the dash receiving portion of the boat deck surface, said dash-engaging means complementarily configured and complementarily located so as to receive said deck-engaging means when the dash is slid into position on the deck surface. The dash can then be fixed in place by positioning one or more fasteners through the dash and into the deck surface, preferably at the rearward edge of the dash, but optionally also at either or both of the side edges of the dash. The engagement of the dash-engaging means of the deck surface with the deck-engaging means of the dash obviates the need for placement of fasteners such as screws or bolts to affix the leading edge of the dash to the boat deck surface, thereby providing an advantage in terms of time savings and labor savings during manufacture, disassembly, or reassembly of the boat. Of course, as will be readily appreciated by the skilled artisan in view of teachings herein, the deck/dash assembly can alternatively, or additionally, be secured by one or more fasteners in proximity to the forward or leading edge of the dash at the interface of the deck/dash assembly.

Further description of the subject invention, including both the boat deck/dash assembly and methods of affixing a dash to a boat deck surface are provided in the following examples, which are intended only to exemplify, and not to limit, the scope of the subject invention.

EXAMPLE 1

Figure 1:
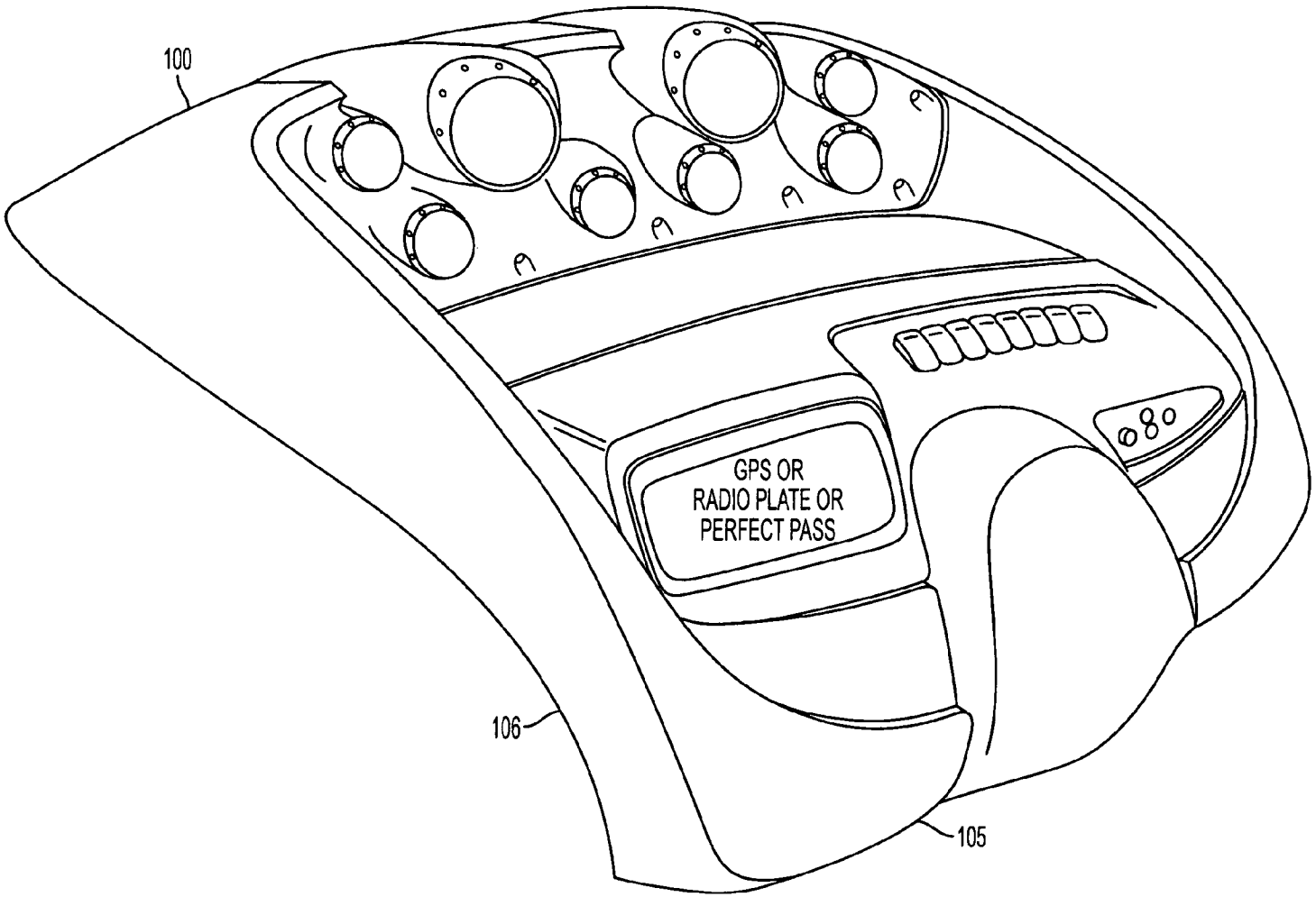
FIG. 1 is a perspective view of the top side of a typical dash before its installation on a boat.
Figure 2:
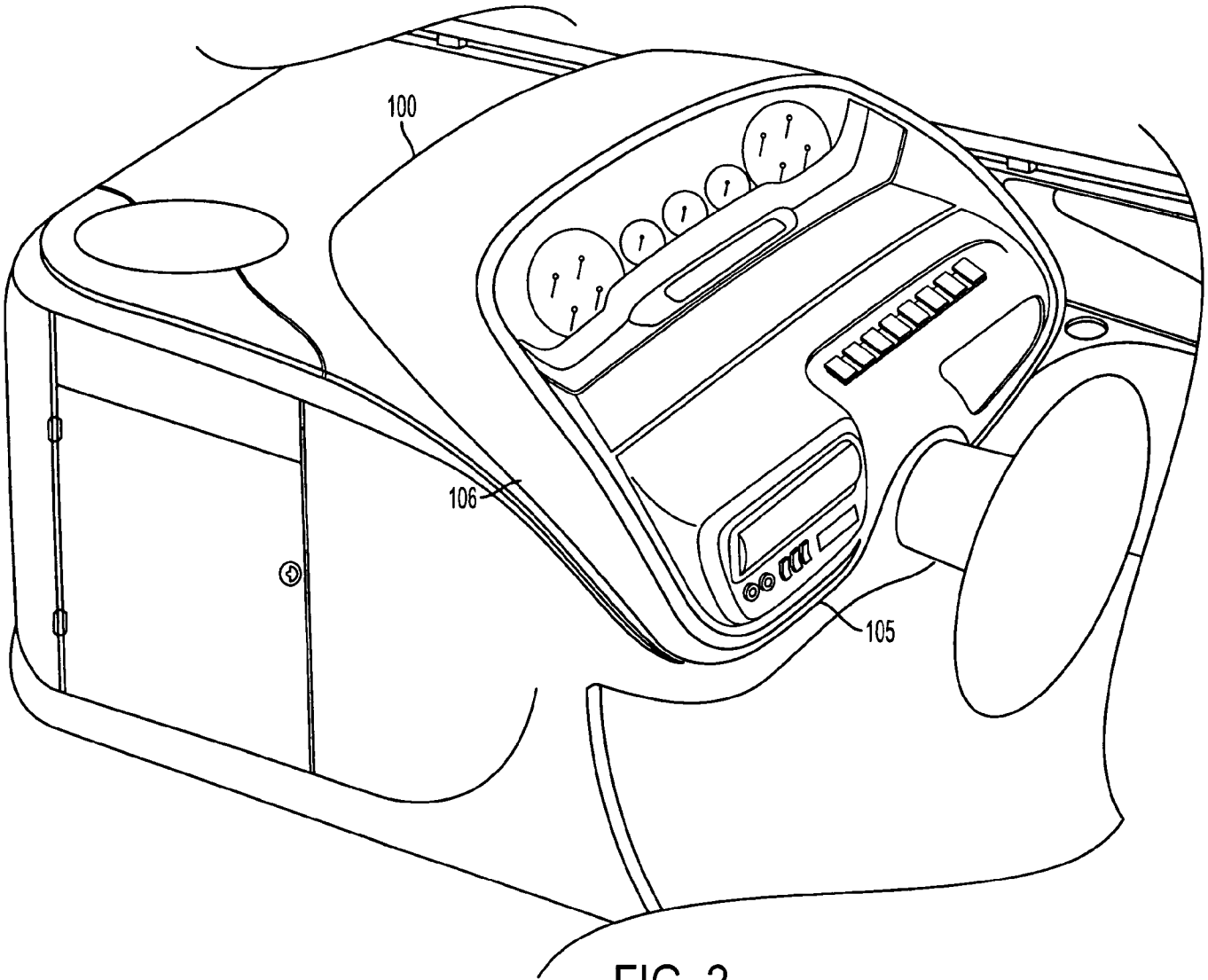
FIG. 2 depicts a boat/dash assembly with the dash mounted in position.
Figure 3:
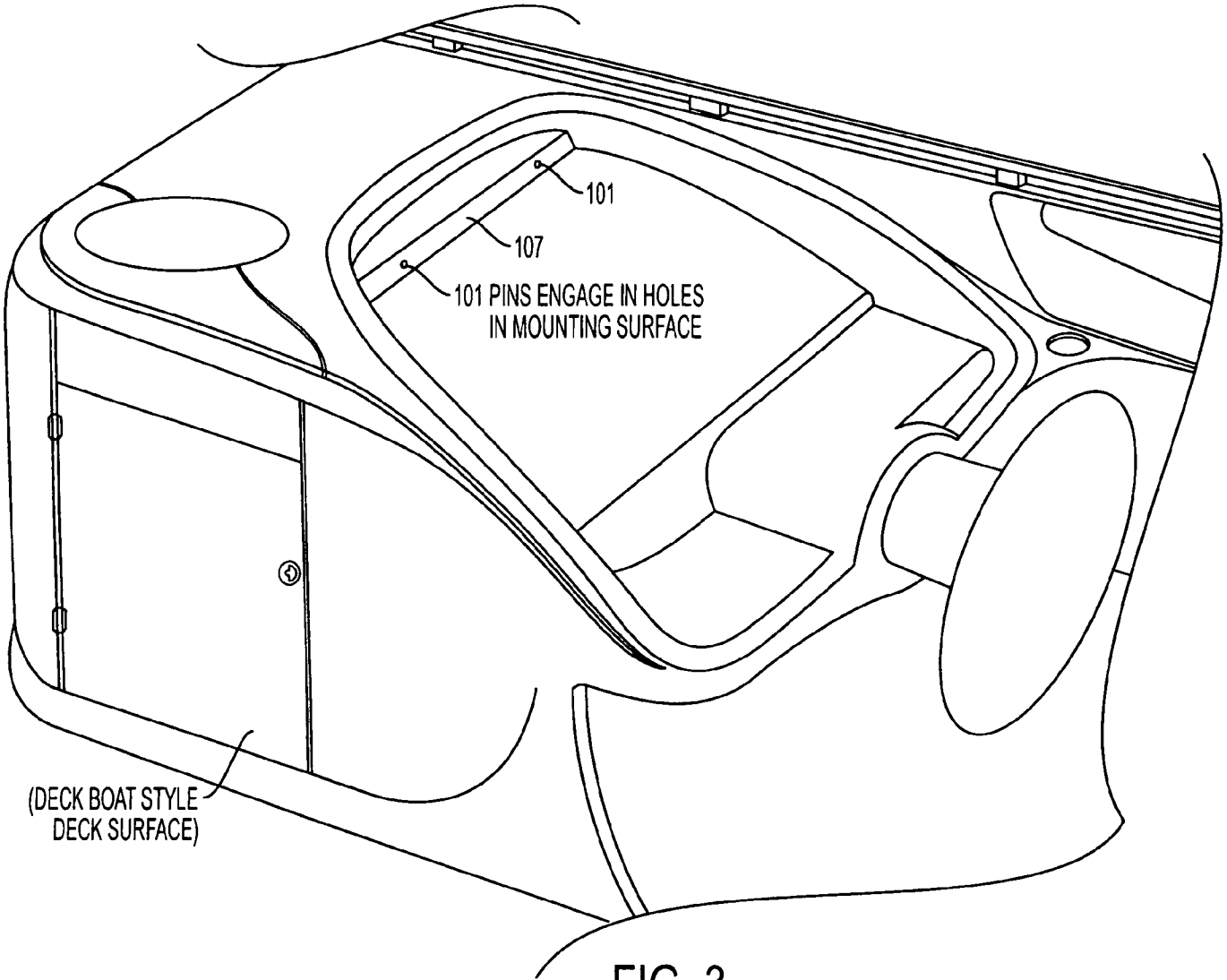
FIG. 3 depicts a boat deck surface according to one embodiment of the subject invention prior to installation of the dash.
Figure 4:
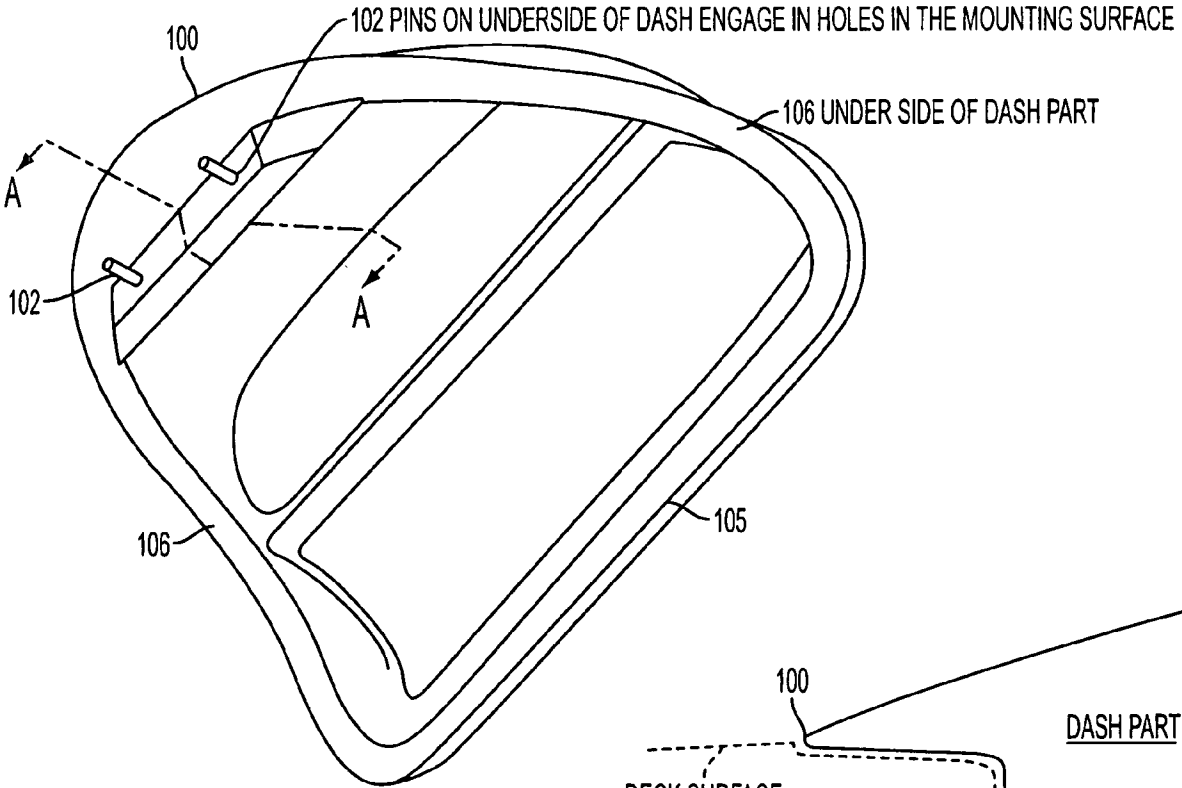
FIG. 4 depicts the underside of a dash according to one embodiment of the subject invention compatible with that version of the deck depicted in FIG. 3.
Figure 5:
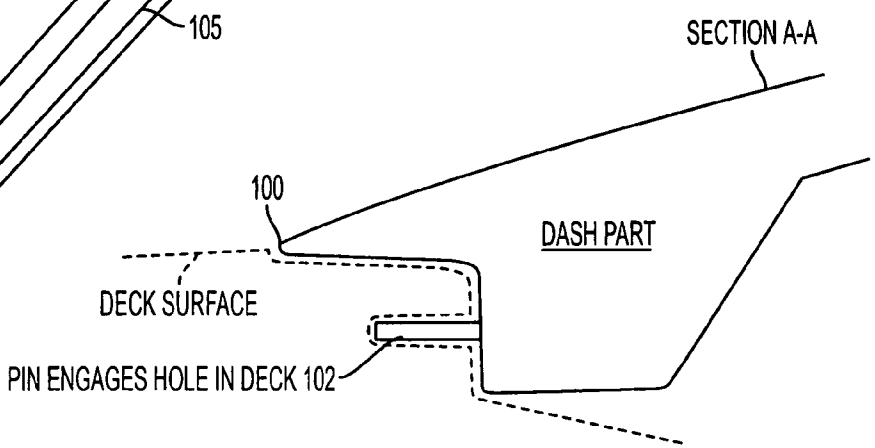
FIG. 5 represents a cross-sectional view of the dash depicted in FIG. 4 through Section A—A.

Referring now to FIG. 1, a standard exemplary dash is depicted having a leading edge 100, and rearward edge 105, and the side edges 106. FIG. 2 shows an exemplary dash in position on a boat deck surface. Reference to FIGS. 3, 4, and 5 will show a boat deck surface, the underside of a dash, and a cross-sectional view of the dash employing one embodiment of the subject invention. In this embodiment the dash-engaging means is exemplified by pin-receiving hole 101 and the deck-engaging means is exemplified by pin 102. FIG. 3 depicts the boat deck surface prior to installation of the dash where the boat deck surface has a dash-receiving surface 107 in which at least one pin-receiving hole 101 is disposed. FIG. 3 depicts an embodiment in which there are two pin-receiving holes 101, but according to the subject invention, as will readily be appreciated by those of ordinary skill in the art in view of the teachings herein, one pin-receiving hole will suffice, or optionally, more than two pin-receiving holes could be used if desired. Referring to FIG. 4, one can see two pins 102 protruding from the underside of a dash proximal to dash-leading edge 100, and complementarily configured in size and position so that when the dash is slid into position on the boat deck surface, pins 102 slide into pin-receiving holes 101 as depicted in FIG. 5, and the dash can be fastened into place by attaching it to the deck surface with at least one fastener, such as screw or bolt, driven though dash rearward edge 105 into the boat deck surface. Optionally, alternatively or in addition to the at least one fastener at rearward edge 105, at least one fastener can be used at either or both of side edges 106 of the dash, or even proximal to leading edge 100 (for example, at a point along A between pin-receiving holes 101). Further, as will be readily apparent to the skilled artisan, pins 102 can be integrally molded into the dash, or optionally attached thereto, while serving their purpose.

EXAMPLE 2

Figure 6:
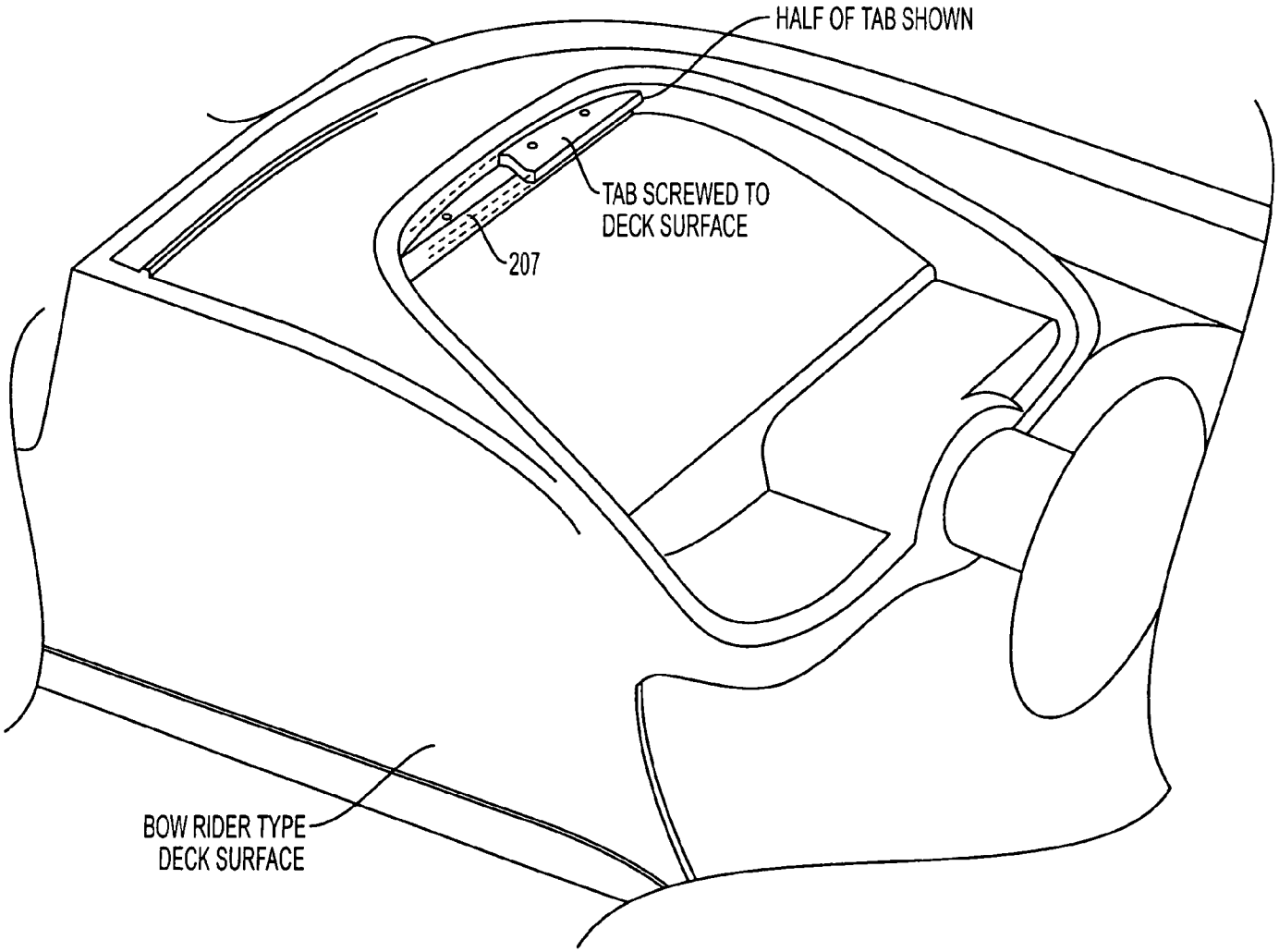
FIG. 6 depicts an alternative embodiment of a boat deck surface according to the subject invention prior to installation of the dash.
Figure 8:
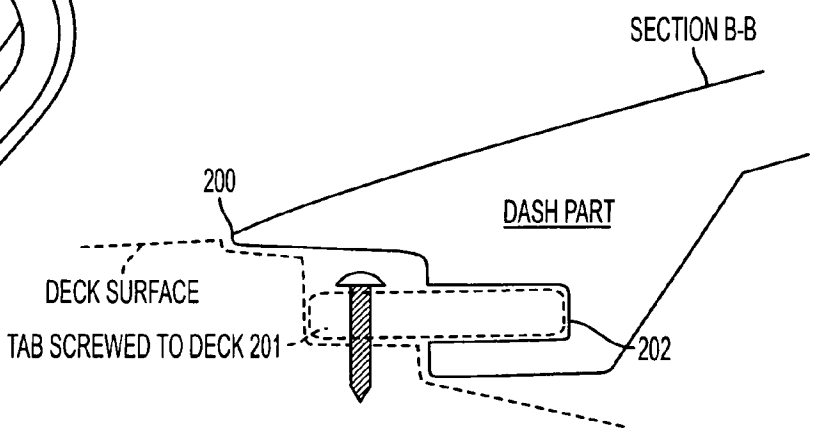
FIG. 8 represents a cross-sectional view of the dash depicted in FIG. 7 through Section B—B.
Figure 7:
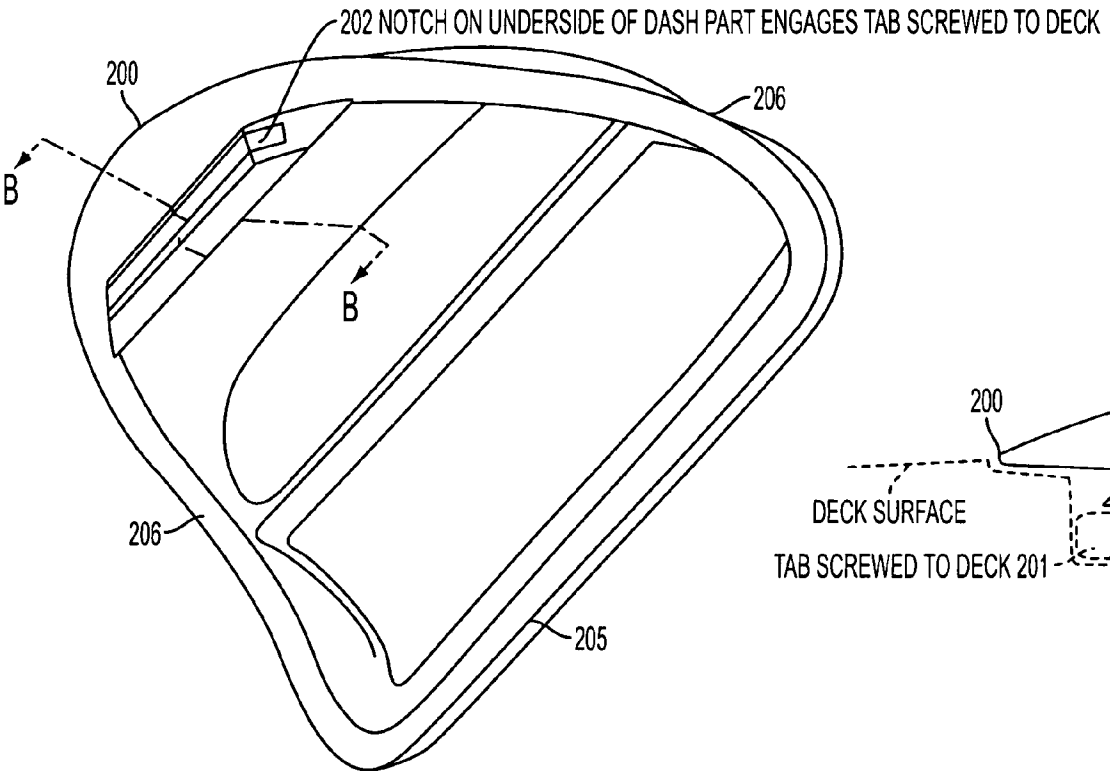
FIG. 7 depicts the underside of a dash according to one embodiment of the subject invention compatible with that version of the deck depicted in FIG. 6.
Figure 9:
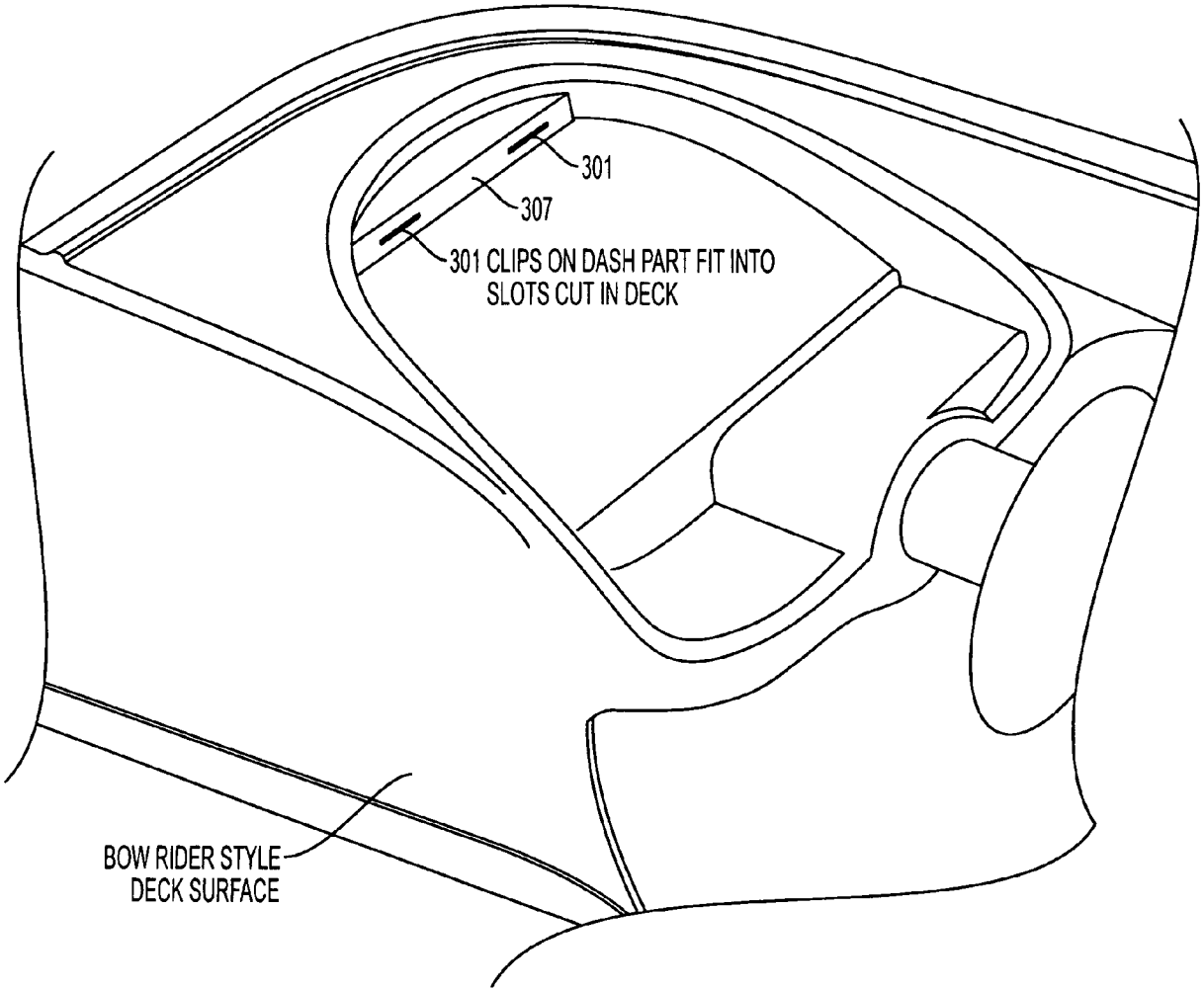
FIG. 9 depicts yet another embodiment of a boat deck surface according to the subject invention prior to installation of the dash.

In an alternative exemplary embodiment depicted in FIG. 6 of the subject invention, the dash-engaging means is at least one dash-holding tab 201 located at the dash-receiving portion 207 of the boat deck surface. For this embodiment, the deck-engaging means located on the underside of the dash proximal to leading edge 200 is a complementarily sized and configured tab-receiving notch 202 which, during the course of assembly as the dash is slid into position on the boat deck surface, receives dash-holding tab 201 as represented by the cross-sectional view shown in FIG. 8. Once the dash of this embodiment has been slid into position such that the dash-engaging means and the deck-engaging means have engaged each other, at least one fastener can be used to affix the dash to the boat deck at rearward edge 205, at either or both side edges 206, or even alternatively or additionally proximal to leading edge 200 (for example, at a point along B). As would be readily apparent to one of ordinary skill in the art, dash-holding tab 201 can either be integrally molded into the boat deck surface, or optionally attached thereto.

EXAMPLE 3

Figure 11:
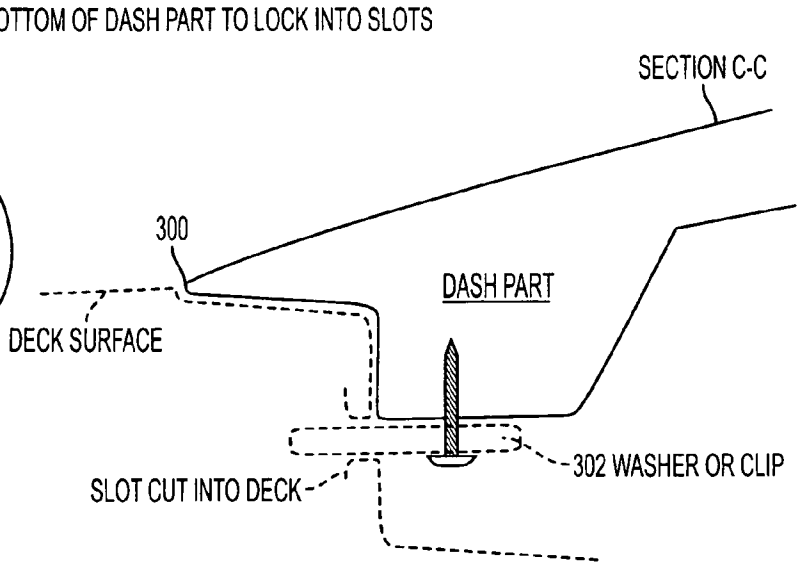
FIG. 11 represents a cross-sectional view of the dash depicted in FIG. 10 through Section C—C.
Figure 12:
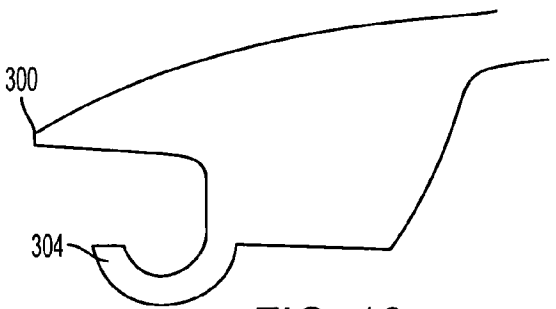
FIG. 12 represents a cross-sectional view of another embodiment of the dash according to the subject invention compatible with the deck of FIG. 9.
Figure 10:
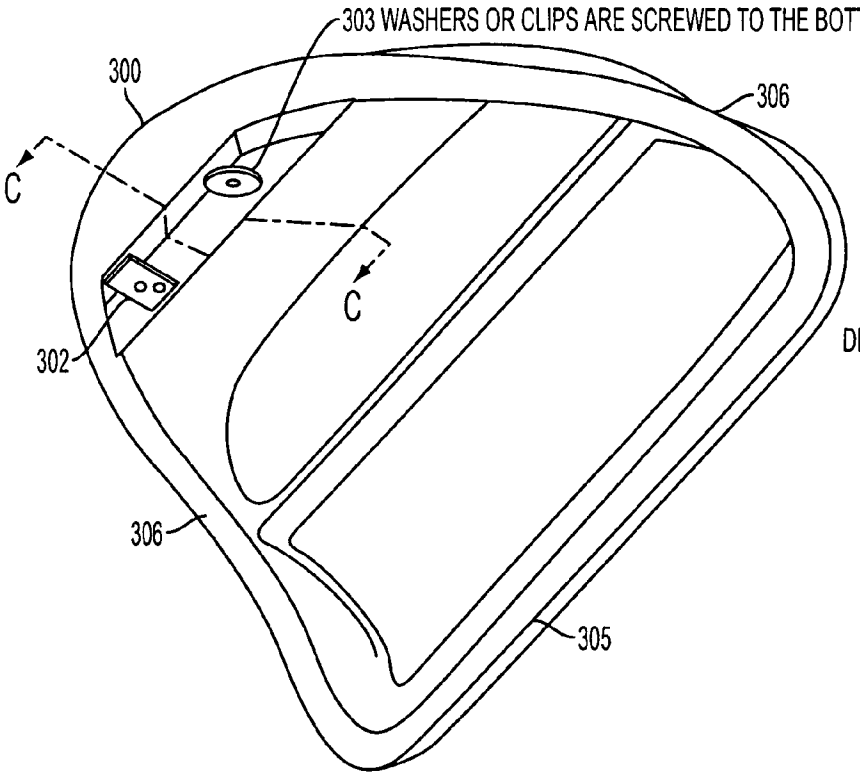
FIG. 10 depicts the underside of a dash according to other embodiments of the subject invention compatible with that version of the deck depicted in FIG. 9.

Still other embodiments of the dash-engaging means and deck-engaging means are depicted in FIGS. 9–12 where the dash-engaging means is represented as at least one slot 301 positioned in dash-receiving portion 307 of the deck surface. As will be readily apparent to the skilled artisan, one or more holes or slots 301 may be used. The complementary deck-engaging means of this embodiment can take the form of a clip 302, washer 303, or other such complementarily shaped and located protrusion positioned and sized so as to engage the at least one hole or slot 301 on the deck surface. In operation, a dash according to this embodiment is slid into position and the deck-engaging means, for example, the clip 302 as depicted in FIG. 11, engages slot 301 and holds the dash in place until at least one fastener can be positioned through dash rearward edge 305 to affix the dash to the deck surface. Optionally, alternatively or in addition to the at least one fastener at dash rearward edge 305, and at least one fastener could be used at either or both of dash side edges 306, or even proximal to leading edge 300 (for example, at a point along C). Yet another embodiment of the deck-engaging means is at least one curved channel or hook 304 as shown cross-sectionally in FIG. 12. This embodiment of the deck-engaging means can engage a slot 301, or, alternatively, a rod (not depicted) which will be affixed at dash-receiving portion 307 complementarily sized and located so as to engage the at least one channel or hook 304, as will be readily apparent to the ordinary skilled artisan. Further as the skilled artisan will readily appreciate, the various hooks, channels, clips, or washers could be attached or alternatively integrally molded to the dash and still accomplish the purpose of the subject invention.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

I claim:

1. A boat deck/dash assembly comprising a dash having a loading edge and a rearward edge, said dash comprising boat deck-engaging moans for engaging a boat deck, said boat deck-engaging means located proximal to said leading edge;

a boat deck surface having a dash receiving portion, said dash receiving portion comprising dash-engaging means for engaging a dash;

said dash-engaging means being complementarily configured and complementarily located so as to receive said boat deck-engaging means when the dash is maneuvered into position on the boat deck surface, such that when the dash is maneuvered into position on the boat deck surface and said boat deck-engaging means and said dash-engaging means are mutually engaged, a boat deck/dash assembly results wherein the dash can be fixed in place to the boat deck by a single fastener connecting the dash to the boat deck;

said dash-engaging means comprising at least one pin-receiving hole and said boat deck-engaging means comprising at least one pin.

2. A boat deck/dash assembly according to claim 1, having at least two pin-receiving holes and at least two pins.

3. A boat deck/dash assembly according to claim 2, wherein there are two pin-receiving holes and two pins.

4. A boat deck/dash assembly comprising a dash having a leading edge and a receiving edge, said dash comprising boat deck-engaging means for engaging a boat deck, said boat deck-engaging means located proximal to said leading edge;

a boat deck surface having a dash receiving portion, said dash receiving portion comprising dash-engaging means for engaging a dash;

said dash-engaging means being complementarily configured and complementarily located so as to receive said boat deck-engaging means when the dash is maneuvered into position on the boat deck surface, such that when the dash is maneuvered into position on the boat deck surface and said boat deck-engaging means and said dash-engaging means are mutually engaged, a boat deck/dash assembly results wherein the dash can be fixed in place to the boat deck by a single fastener connecting the dash to the boat deck;

said dash-engaging means comprising at least one tab-receiving notch and said boat deck-engaging means comprising at least one tab.

5. A boat deck/dash assembly according to claim 4, having at least two tab-receiving notches and at least two tabs.

6. A boat deck/dash assembly according to claim 4, wherein there is one tab-receiving notch and one tab.

7. A boat deck/dash assembly comprising a dash having a leading edge and a receiving edge, said dash comprising boat deck-engaging means for engaging a boat deck, said boat deck-engaging means located proximal to said leading edge;

a boat deck surface having a dash receiving portion, said dash receiving portion comprising dash-engaging means for engaging a dash;

said dash-engaging means being complementarily configured and complementarily located so as to receive said boat deck-engaging means when the dash is maneuvered into position on the boat deck surface, such that when the dash is maneuvered into position on the boat deck surface and said boat deck-engaging means and said dash-engaging means are mutually engaged, a boat deck/dash assembly results wherein the dash can be fixed in place to the boat deck by a single fastener connecting the dash to the boat deck;

said dash-engaging means comprising at least one hole and said boat deck-engaging means comprising at least one protrusion.

8. A boat deck/dash assembly according to claim 7, having at least two holes and at least two protrusions.

9. A boat clock/dash assembly according to claim 7, wherein said at least one protrusion is a clip.

10. A boat deck/dash assembly according to claim 7, wherein said at least one protrusion is a hook.

11. A boat deck/dash assembly according to claim 8, wherein said at least two protrusions are clips.

12. A boat deck/dash assembly according to claim 8, wherein said at least two protrusions are hooks.

13. A boat deck/dash assembly according to claim 7, wherein said at least one hole is a slot.

14. A boat deck/dash assembly according to claim 13, wherein said at least one protrusion is a washer.

15. A boat deck/dash assembly according to claim 13, having at least two slots and at least two protrusions.

16. A boat deck/dash assembly according to claim 15, wherein said at least two protrusions are washers.

17. A boat deck/dash assembly according to claim 13, wherein said at least one protrusion is a clip.

18. A boat deck/dash assembly according to claim 15, wherein said at least two protrusions are clips.

19. A boat deck/dash assembly according to claim 13, wherein said at least one protrusion is a channel.

20. A boat deck/dash assembly according to claim 15, wherein said at least two protrusions are channels.

21. A boat deck/dash assembly comprising a dash having a leading edge and a receiving edge, said dash comprising boat deck-engaging means for engaging a boat deck, said boat deck-engaging means located proximal to said leading edge;

a boat deck surface having a dash receiving portion, said dash receiving portion comprising dash-engaging means for engaging a dash;

said dash-engaging means being complementarily configured and complementarily located so as to receive said boat deck-engaging means when the dash is maneuvered into position on the boat deck surface, such that when the dash is maneuvered into position on the boat deck surface and said boat deck-engaging means and said dash-engaging means are mutually engaged, a boat deck/dash assembly results wherein the dash can be fixed in place to the boat deck by a single fastener connecting the dash to the boat deck;

said dash-engaging means comprising at least one rod and wherein said boat deck-engaging means comprising at least one protrusion.

22. A boat deck/dash assembly according to claim 21, wherein said at least one protrusion is a channel.

23. A boat deck/dash assembly according to claim 21, wherein said at least one protrusion is a hook.

24. A boat deck/dash assembly according to claim 21, having at least two rods and at least two protrusions.

25. A boat deck/dash assembly according to claim 24, wherein said at least two protrusions are channels.

26. A boat deck/dash assembly according to claim 24, wherein said at least two protrusions are hooks.

27. A method of making a boat deck/dash assembly, comprising the steps of:

providing a dash having a leading edge and a rearward edge, said dash comprising boat deck-engaging means for engaging a boat deck, said boat deck-engaging means located proximal to said leading edge;

providing a boat deck surface having a dash receiving portion, said dash receiving portion comprising dash-engaging means for engaging a dash, said dash-engaging means being complementarily configured and complementarily located so as to receive said boat deck-engaging means when the dash is maneuvered into position on the deck surface, such that when the dash is maneuvered into position on the boat deck surface and said boat deck-engaging means and said dash-engaging means are mutually engaged, a boat deck/dash assembly results wherein the dash can be fixed in place to the boat deck by a single fastener connecting the dash to the boat deck;

said dash-engaging means comprising at least one pin-receiving hole and said boat deck-engaging means comprising at least one pin; and maneuvering said dash into place on said boat deck such that said boat deck-engaging means and said dash-engaging means engage each other, thereby making a boat deck/dash assembly.

28. A method according to claim 27, having at least two pin-receiving holes and at least two pins.

29. A method according to claim 28, wherein there are two pin-receiving holes and two pins.

30. A method of making a boat deck/dash assembly, comprising the steps of:

providing a dash having a leading edge and a rearward edge, said dash comprising boat deck-engaging means for engaging a boat deck, said boat deck-engaging means located proximal to said leading edge;

providing a boat deck surface having a dash receiving portion, said dash receiving portion comprising dash-engaging means for engaging a dash, said dash-engaging means being complementarily configured and complementarily located so as to receive said boat deck-engaging means when the dash is maneuvered into position on the deck surface, such that when the dash is maneuvered into position on the boat deck surface and said boat deck-engaging means and said dash-engaging means are mutually engaged, a boat deck/dash assembly results wherein the dash can be fixed in place to the boat deck by a single fastener connecting the dash to the boat deck;

said dash-engaging means comprising at least one pin-receiving at least tab-receiving notch and said boat deck-engaging means comprising at least one tab; and maneuvering said dash into place on said boat deck such that said boat deck-engaging means and said dash-engaging means engage each other, thereby making a boat deck/dash assembly.

31. A method according to claim 30, having at least two tab-receiving notches and at least two tabs.

32. A method according to claim 30, having at least two tab-receiving notch and at least one tab.

33. A method of making a boat deck/dash assembly, comprising the steps of:

providing a dash having a leading edge and a rearward edge, said dash comprising boat deck-engaging means for engaging a boat deck, said boat deck-engaging means located proximal to said leading edge;

providing a boat deck surface having a dash receiving portion, said dash receiving portion comprising dash-engaging means for engaging a dash, said dash-engaging means being complementarily configured and complementarily located so as to receive said boat deck-engaging means when the dash is maneuvered into position on the deck surface, such that when the dash is maneuvered into position on the boat deck surface and said boat deck-engaging means and said dash-engaging means are mutually engaged, a boat deck/dash assembly results wherein the dash can be fixed in place to the boat deck by a single fastener connecting the dash to the boat deck;

said dash-engaging means comprising at least one hole and said boat deck-engaging means comprising at least one protrusion; and maneuvering said dash into place on said boat deck such that said boat deck-engaging means and said dash-engaging means engage each other, thereby making a boat deck/dash assembly.

34. A method according to claim 33, having at least two holes and at least two protrusions.

35. A method according to claim 33, wherein said at least one protrusion is a clip.

36. A method according to claim 33, wherein said at least one protrusion is a hook.

37. A method according to claim 34, wherein said at least two protrusions are clips.

38. A method according to claim 34, wherein said at least two protrusions are hooks.

39. A method according to claim 33, wherein said at least one hole is a slot.

40. A method according to claim 39, wherein said at least one protrusion is a washer.

41. A method according to claim 39, having at least two slots anti at least two protrusions.

42. A method according to claim 41, wherein said at least two protrusions are washers.

43. A method according to claim 39, wherein said at least one protrusion is a clip.

44. A method according to claim 41, wherein said at least two protrusions are clips.

45. A method according to claim 39, wherein said at least one protrusion is a channel.

46. A method according to claim 41, wherein said at least two protrusions are channels.

47. A method of making a boat deck/dash assembly, comprising the steps of:

providing a dash having a leading edge and a rearward edge, said dash comprising boat deck-engaging means for engaging a boat deck, said boat deck-engaging means located proximal to said leading edge;

providing a boat deck surface having a dash receiving portion, said dash receiving portion comprising dash-engaging means for engaging a dash, said dash-engaging means being complementarily configured and complementarily located so as to receive said boat deck-engaging means when the dash is maneuvered into position on the deck surface, such that when the dash is maneuvered into position on the boat deck surface and said boat deck-engaging means and said dash-engaging means are mutually engaged, a boat deck/dash assembly results wherein the dash can be fixed in place to the boat deck by a single fastener connecting the dash to the boat deck;

said dash-engaging means comprising at least one rod and said boat deck-engaging means comprising at least one protrusion; and maneuvering said dash into place on said boat deck such that said boat deck-engaging means and said dash-engaging means engage each other, thereby making a boat deck/dash assembly.

48. A method according to claim 47, wherein said at least one protrusion is a channel.

49. A method according to claim 47, wherein said at least one protrusion is a hook.

50. A method according to claim 47, having at least two rods and at least two protrusions.

51. A method according to claim 50, wherein said at least two protrusion are channels.

52. A method according to claim 50, wherein said at least two protrusions are hooks.

* * * * *